US005928846A

United States Patent [19]

Yamashita et al.

[11] Patent Number: 5,928,846

[45] Date of Patent: Jul. 27, 1999

[54] METHOD FOR PROCESSING SILVER HALIDE PHOTOGRAPHIC LIGHT-SENSITIVE MATERIAL

[75] Inventors: Hirobumi Yamashita; Naoko Fukuwatari; Toshiyuki Marui, all of Hino, Japan

[73] Assignee: Konica Corporation, Japan

[21] Appl. No.: 09/087,260

[22] Filed: May 29, 1998

[30] Foreign Application Priority Data

Jun. 6, 1997 [JP] Japan ..... 9-165181
Jun. 24, 1997 [JP] Japan ..... 9-167101

[51] Int. Cl.[6] ..... G03C 5/26

[52] U.S. Cl. ..... 430/448; 430/445; 430/488; 430/490; 430/566

[58] Field of Search ..... 430/445, 448, 430/488, 490, 566

[56] References Cited

U.S. PATENT DOCUMENTS 5,840,471 11/1998 Fukuwatari et al. ..... 430/490

*Primary Examiner*—Hoa Van Le
*Attorney, Agent, or Firm*—Jordan B. Bierman; Bierman, Muserlian and Lucas

[57] ABSTRACT

A method for processing a silver halide photographic light-sensitive material is disclosed. The processing method comprises the step of (1) developing a silver halide photographic light-sensitive material which comprises a support having thereon a silver halide emulsion layer and a hydrophilic colloid layer adjoining with the silver halide emulsion layer, and at least one of the silver halide emulsion layer and the hydrophilic colloid layer contains a phosphazene compound and a compound represented by the following Formula 1 or 2 by a developing solution and (2) fixing the silver halide photographic light-sensitive material by a fixing solution, Formula 1 wherein $R_1$ and $R_2$ are each independently a hydroxyl group, a mercapto group, an amino group, an acylamino group, an alkylsulfonylamino group, an arylsulfonylamino group, an alkoxycarbonyl group or an alkylthio group, and Z is a group of atoms necessary to form a 5- or 6-member ring, Formula 2 wherein R is an aryl group, $R_3$, $R_4$, $R_5$ and $R_6$ are each independently a hydrogen atom, an alkyl group, an aralkyl group or an aryl group.

15 Claims, No Drawings

METHOD FOR PROCESSING SILVER HALIDE PHOTOGRAPHIC LIGHT-SENSITIVE MATERIAL

FIELD OF THE INVENTION

This invention relates to a method for processing a silver halide photographic light-sensitive material, by which an silver image having a pure black tone and a good image tone and a excellent photographic properties can be obtain even when the light-sensitive material is subjected to a rapid processing using a developing solution with a lowered amount of replenishing.

BACKGROUND OF THE INVENTION

Recently, shortening of the processing time and reducing of the waste liquid for decreasing the environmental pollution have been demanded with respect to the processing of a silver halide photographic light-sensitive material, hereinafter referred to a light-sensitive material. For example, in the field of medicine, the amount of radiophotograph is increased accompanied with a swift increasing of medical examination such as those in a medical health check and a common medical diagnosis. Thus demands to further raise the rapidity of processing and to further reduce of the waste processing liquid are increasingly strengthened.

A light-sensitive material which can be rapidly developed, fixed and dried is required to perform the processing in a shortened time. It has been known that a tabular silver halide grain is effective to obtain a high sensitivity and a high covering power. Such the tabular grain has a larger surface area compared with a regular silver halide grain such as a hexagonal or an octahedral grain. Accordingly, the tabular grain has an advantage that a high sensitivity can be obtained since a larger amount of spectral sensitizer can be adsorbed on the grain surface.

On the other hand, a silver image formed from a silver halide grain having a small size or a small thickness such as the tabular grain has a drawback that the tone of the silver image is yellowish since blue light is strongly scattered by the silver image formed from such the grain.

It is preferred in the case of a medical radiographic light-sensitive material that the tone of silver image is pure black or blue black from the viewpoint of diagnosis. The yellowish image is not suitable for diagnosis and is displeasure for the observer.

Various techniques for improving the tone of the silver image have been proposed from the viewpoint of the light-sensitive material and the processing therefor. For example, a specific mercapto compound has been known but such the compound has a considerable desensitizing effect.

Recently, a technique is disclosed in JP O.P.I. No. 5-165147, in which a specific dye is dissolved in a water-insoluble high-boiling organic solvent and dispersed in an aqueous medium in a form of fine particles, and added into a light-sensitive material.

However, the light-sensitive material according to this method has a drawback such that the sensitivity is considerably changed during the storage. Moreover, such the light-sensitive material shows a problem that a stain is sticked to a fluorescent intensifying screen to be contacted to the light-sensitive material when such the light-sensitive material is used as a medical radiographic light-sensitive material. The light-sensitive material further has a drawback that the fog density is increased since the amount of the dye contained in the none image area is the same as that contained in the image formed area of the light-sensitive material.

To solved such the problem, a method is proposed in JP O.P.I. 3-157645, in which a non-diffusible compound capable of releasing a diffusible dye corresponding to the silver image formation is used. The effects of this method is insufficient to improve the tone of silver image and to reduce the fog. Furthermore, this method has a problem such that the improvement effect on the image tone and the fog is increased by the storage under a serious condition.

SUMMARY OF THE INVENTION

The object of the invention is to provide a method for processing a silver halide photographic light-sensitive material, by which an silver image having a pure black tone and excellent photographic properties can be obtain even when the light-sensitive material is subjected to a rapid processing using a developing solution with a reduced amount of replenishing.

The above-mentioned object of the invention can be attained by a method for processing a silver halide photographic light-sensitive material comprising the step of developing a silver halide photographic light-sensitive material which comprises a support having thereon a silver halide emulsion layer and a hydrophilic colloid layer adjoining to the silver halide emulsion layer and at least one of the silver halide emulsion layer and the hydrophilic colloid layer contains a phosphazene compound and a compound represented by the following Formula 1 or 2 by a developing solution, Formula 1

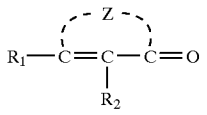

wherein $R_1$ and $R_2$ are each independently a hydroxyl group, a mercapto group, an amino group, an acylamino group, an alkylsulfonylamino group, an arylsulfonylamino group, an alkoxycarbonyl group or an alkylthio group, and Z is a group of atoms necessary to form a 5- or 6-member ring, Formula 2

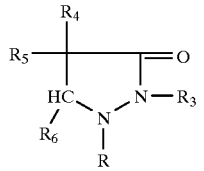

wherein R is an aryl group, $R_3$, $R_4$, $R_5$ and $R_6$ are each independently a hydrogen atom, an alkyl group, an aralkyl group or an aryl group.

DETAILED DESCRIPTION OF THE INVENTION

Examples of the compound represented by the foregoing Formula 1 are shown below.

1-1
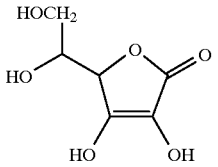
1-2
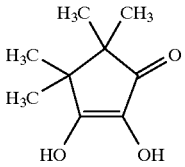
1-3
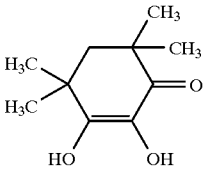
1-4
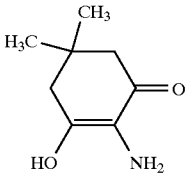
1-5
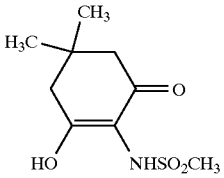
1-6
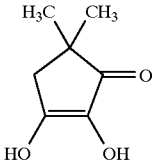
1-7
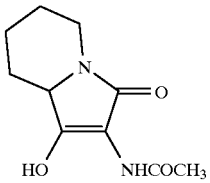
1-8
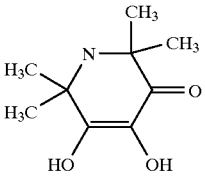
1-9
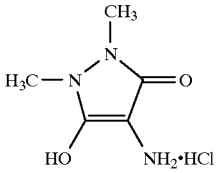
1-10
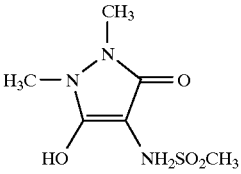
1-10
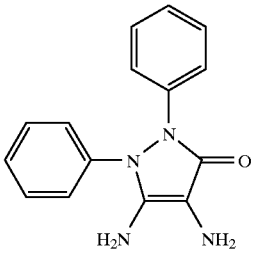
1-12
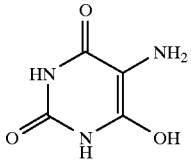
1-13
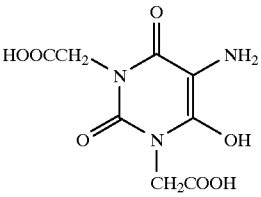
-continued
1-14
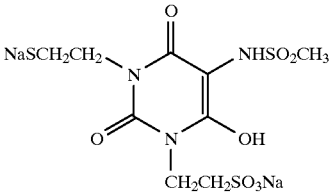
1-15
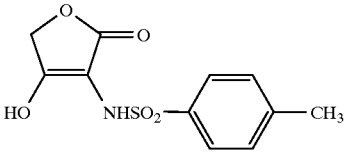
1-16
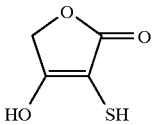
1-17
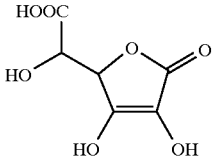
1-18
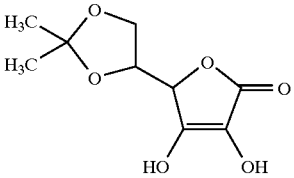
1-19
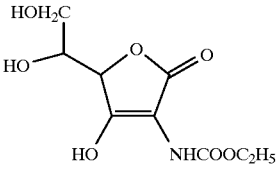
1-20
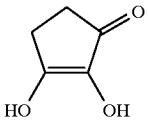
1-21
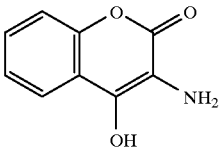
1-22
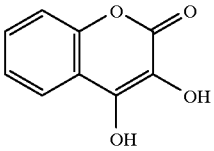

The compound represented by Formula 1 may be added into the silver halide emulsion layer or the hydrophilic colloid layer adjoined to the emulsion layer by adding the compound to the coating solution of the silver halide emulsion or that of the hydrophilic colloid layer. The compound may be optionally may be added at any step in the course of from the silver halide grain formation to the coating of the emulsion.

The adding amount of the compound is preferably from $5\times10^{-5}$ moles to $5\times10^{-3}$ moles, more preferably from $1\times10^{-4}$ moles to $1\times10^{-3}$ moles, per mole of silver halide when the compound is added to the emulsion layer. When the compound is added to the hydrophilic colloid layer adjoined to the silver halide emulsion layer, the amount of the compound is similar to that to be added to the emulsion layer. It is preferred that the compound is added to the silver halide emulsion layer.

Example of the compound represented by the foregoing Formula 2 are shown below.

2-1 1-phenyl-3-pyrazolidone
2-2 1-phenyl-4,4-dihydroxymethyl-3-pyrazolidone
2-3 1-phenyl-4,4-dimethyl-3-pyrazolidone
2-4 1-phenyl-4-hydroxymethyl-4-methyl-3-pyrazolidone
2-5 1=p-tolyl-4,4-dihydroxymethyl-3-pyrazolidone
2-6 1-phenyl-2-hydroxymethyl-4,4-dimethyl-3-pyrazolidone
2-7 1-phenyl-2-morpholinomethyl-4,4-dimethyl-3-pyrazolidone
2-8 1-phenyl-2-morpholinomethyl-4-methyl-3-pyrazolidone
2-9 1-phenyl-2-hydroxymethyl-4-methyl-3-pyrazolidone
2-10 1-phenyl-5,5-dimethyl-3-pyrazolidone
2-11 1-phenyl-5-methyl-3-pyrazolidone
2-12 1-p-tolyl-4-hydroxymethyl-4-methyl-3-pyrazolidone
2-13 1-p-hydroxyphenyl-4,4-dimethyl-3-pyrazolidone
2-14 1-o-tolyl-4-hydroxymethyl-4-methyl-3-pyrazolidone
2-15 1-p-methoxyphenyl-4-hydroxymethyl-4-methyl-3-pyrazolidone
2-16 1-(3,5-dimethyl)phenyl-4-hydroxymethyl-4-methyl-3-pyrazolidone The compound represented by Formula 2 may be added into the silver halide emulsion layer or the hydrophilic colloid layer adjoined to the emulsion layer by adding the compound to the coating solution of the silver halide emulsion or that of the hydrophilic colloid layer. The compound may be optionally added at any step of the course from the silver halide grain formation to the coating of the emulsion. The ading amount of the compound is preferably from $5\times10^{-5}$ moles to $1\times10^{-1}$ moles, more preferably from $1\times10^{-4}$ moles to $5\times10^{-2}$ moles, per mole of silver halide when the compound is added to the emulsion layer. When the compound is added to the hydrophilic colloid layer adjoined to the silver halide emulsion layer, the amount of the compound represented by Formula 2 is similar to that to be added to the emulsion layer. It is preferred that the compound is added to the silver halide emulsion layer.

In the invention, the phosphazene compound to be added to the light-sensitive material is preferably a compound represented by the following Formula 3 or 4.

Formula 3

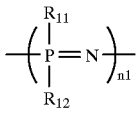

-continued

Formula 4

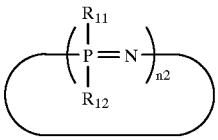

wherein $R_{11}$ and $R_{12}$ are each independently an alkyl group, an alkoxyl group, an aryloxyl group, an aryl group, an isothiocyanato group, an amino group, an alkylthio group, an arylthio group or an azide group, these groups each may have a substituent, and the groups represented by $R_{11}$ and $R_{12}$ may be the same or different. $n_1$ is an integer of 1 or more, and $n_2$ is an integer 3 or more, $R_{11}$ and $R_{12}$ may be the same or different from each other in the different repeating unit.

The compound represented by the foregoing Formula 3 or 4 is a phosphazene derivative having a principal skeleton of P═N bond, and has an ionic side chain, a side chain of π-electron system or a polyether side chain. The compound include a group of high molecular liner compounds, a group of cyclic compounds, and a group of cyclic-chain compounds. These compounds can be synthesized by reaction of halogen atoms of a trimer, tetramer or oligomer of N═P compound each having fluorine atoms as the side chain such as $(PNF_2)_3$, $(PNF_2)_4$ or $(PNF_2)_n$, that having chlorine atoms as the side chain such as $(PNCl_2)_3$, $(PNCl_2)_4$ or $(PNCl_2)_n$, n is not more than 15, that having bromine atoms as the side chain such as $(PNBr_2)_3$, $(PNBr_2)_4$ or $(PNBr_2)_n$, or that having iodine atoms as the side chain such as $(PNI_2)_3$, $(PNI_2)_4$ or $(PNO_2)_n$, with a metal salt of an aromatic organic compound such as $C_6H_5ONa$, $CH_3C_6H_4ONa$, $(C_6H_5O)_2Ca$, or $CF_3CH_2ONa$. The compounds may also be synthesized by reaction of the foregoing N═P compound and a mixture of an aromatic compound capable of nuclear attractively substituting with the halogen atom bonded to the phosphor atom, for example, an aromatic compound having a hydroxyl group such as $C_6H_5OH$, an aliphatic alcohol such as $CH_2{=}C(CH_3){-}COOCH_2CH_2OH$, or an aromatic amine such as $C_6H_5NH_2$, and a halogen acceptor, for example, an amine such as aniline, sodium hydroxide or sodium carbonate.

Although the phosphazene compound can be synthesized as above, the synthesizing method is not limited thereto.

The aromatic side chain group may be a group derived from a compound having an aromatic ring which has a hydroxyl group as a functional group such as followings:

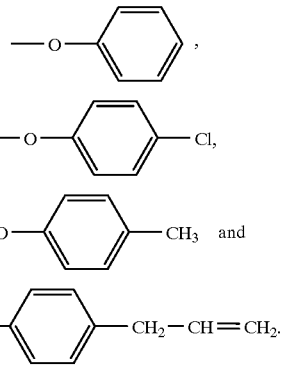

The aromatic side chain group may be a group derived from a compound of aromatic ring having an amino group as a functional group such as aniline or phenylenediamine.

Examples of such the group are as follows:

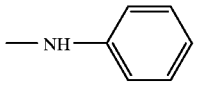

and

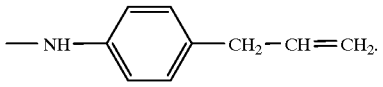

The aromatic side chain group may also be a group derived from a compound of aromatic ring having a mercapto group as a functional group such as thiophenol and dimercaptobenzene. Examples of such the group are as follows:

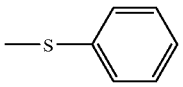

and

-continued

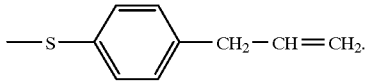

The side chain groups in the phosphazene compound may be the same or a combination of plural groups selected from the above-mentioned.

Moreover, the side chain group may be the functional groups described in "Chem. Rev.", vol. 172, No. 4, p.p. 315–356, 1972. Such the functional group may have a hydrophilic substituent such as a carboxyl group, a sulfric acid group and a phosphoric acid group.

The solubility of the phosphazene compound can be controlled by the selection of the side chain group. The solubility of the phosphazene compound to be added to the emulsion layer or the hydrophilic colloid layer adjoined to the emulsion layer is preferably not more than 1 g in 100 g of an aqueous solution having a pH of 10.00 at 40° C.

Examples of the compound represented by Formula 3 or 4 are shown below. In the followings, Mn is a number average molecular weight.

| | | |
|---|---|---|
| L-1 | $[NP(NCS)_2]_n$ | Mn = 300,000 |
| L-2 | $[NP(OCH_3)_2]_n$ | Mn = 280,000 |
| L-3 | $[NP(OC_2H_5)_2]_n$ | Mn = 300,000 |
| L-4 | $[NP(OCH_2CF_3)_2]_n$ | Mn = 300,000 |
| L-5 | $[NP(OCH_2C_2F_5)_2]_n$ | Mn = 320,000 |
| L-6 | $[NP(OCH_2CF_2CF_2H)_2]_n$ | Mn = 320,000 |
| L-7 | $[NP(OCH_2C_3H_7)_2]_n$ | Mn = 340,000 |
| L-8 | $[NP(OCH_2CF_3)(OCH_2C_3F_7)]_n$ | Mn = 330,000 |
| L-9 | $[NP(OCH_2(CF_2)_6CF_3)_2]_n$ | Mn = 350,000 |
| L-10 | $[NP(OCH_2C_2F_5)(OCH_2C_3F_7)]_n$ | Mn = 350,000 |
| L-11 | $[NP(OCH_2CF_2CF_2H)(OCH_2C_6F_{12}H)]_n$ | Mn = 380,000 |
| L-12 | $[NP(OC_6H_5)_2]_n$ | Mn = 220,000 |
| L-13 | $[NP(OC_6H_4F\text{-}p)_2]_n$ | Mn = 220,000 |
| L-14 | $[NP(OC_6H_4CF_3\text{-}m)_2]_n$ | Mn = 220,000 |
| L-15 | $[NP(OC_6H_4Cl\text{-}p)_2]_n$ | Mn = 230,000 |
| L-16 | $[NP(OC_6H_3C_2\text{-}2,4)_2]_n$ | Mn = 230,090 |
| L-17 | $[NP(OC_6H_4C_6H_5\text{-}p)_2]_n$ | Mn = 220,000 |
| L-18 | $[NP(NHCH_3)_2]_n$ | Mn = 280,000 |
| L-19 | $[NP(NHC_2H_5)_2]_n$ | Mn = 290,000 |
| L-20 | $[NP(NHC_3H_7\text{-}n)_2]_n$ | Mn = 280,000 |
| L-21 | $[NP(NHC_4H_9\text{-}n)_2]_n$ | Mn = 285,000 |
| L-22 | $[NP(NHC_6H_5)_2]_n$ | Mn = 300,000 |
| L-23 | $[NP(N(CH_3)_2)_2]_n$ | Mn = 280,000 |
| L-24 | $[NP(NC_5H_{10})_2]_n$ | Mn = 300,000 |
| L-25 | $[NP(N(C_2H_5)_2)Cl]_n$ | Mn = 300,000 |
| L-26 | $[NP(N(C_2H_5)_2)(NH_2)]_n$ | Mn = 200,000 |
| L-27 | $[NP(N(C_2H_5)_2)(NHCH_3)]_n$ | Mn = 230,000 |
| L-28 | $[NP(N(C_2H_5)_2)(NHC_2H_5)]_n$ | Mn = 250,000 |
| L-29 | $[NP(N(C_2H_5)_2)(NHC_3H_7\text{-}n)]_n$ | Mn = 280,000 |
| L-30 | $[NP(N(C_2H_5)_2)(NHC_4H_9\text{-}n)]_n$ | Mn = 180,000 |
| L-31 | $(NP(C_6H_5)_2)_n$ | Mn = 220,000 |
| L-32 | $[NP(SC_2H_5)_2]_n$ | Mn = 250,000 |
| L-33 | $[NP(NH_2)_2]_n$ | Mn = 270,000 |

L-34

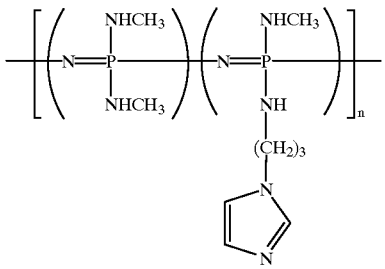

C-1

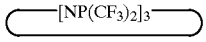

-continued

C-2 $(NP(C_6H_5)_2)_3$

C-3 $(NP(C_6H_5)_2)_4$

C-4 $[NP(C_6H_4Cl\text{-}p)_2]_3$

C-5 $(NP(C_2H_5)_2)_3$

C-6 $(NP(C_2H_5)_2)_4$

C-7 $[NP(OCH_2CF_3)_2]_3$

C-8 $[NP(OCH_3)_2]_3$

C-9 $[NP(OCH_3)_2]_4$

C-10 $[NP(OC_2H_5)_2]_3$

C-11 $[NP(OC_2H_5)_2]_4$

C-12 $[NP(OC_3H_7\text{-}i)_2]_3$

C-13 $[NP(OC_3H_7\text{-}i)_2]_4$

C-14 $[NP(OC_4H_9\text{-}n)_2]_3$

C-15 $[NP(OC_4H_9\text{-}n)_2]_4$

C-16 $[NP(OCH_2C_6H_5)_2]_3$

C-17 $[NP(OCH_2C_6H_5)_2]_4$

C-18 $[NP(OC_6H_5)_2]_3$

C-19 $[NP(OC_6H_5)_2]_4$

C-20 $[NP(SC_2H_5)_2]_4$

C-21 $[NP(SC_2H_5)_2]_3$

C-22 $[NP(NHCH_3)_2]_3$

C-23 $[NP(NHCH_3)_2]_4$

C-24 $[NP(NHC_2H_5)_2]_3$

C-25 $[NP(NHC_2H_5)_2]_4$

-continued

| | |
|---|---|
| C-26 | $[NP(NHC_4H_9\text{-}n)_2]_3$ |
| C-27 | $[NP(NHC_4H_9\text{-}n)_2]_4$ |
| C-28 | $[NP(N(CH_3)_2)_2]_3$ |
| C-29 | $[NP(N(CH_3)_2)_2]_4$ |
| C-30 | $[NP(N(C_2H_5)_2)_2]_3$ |
| C-31 | $[NP(N(C_2H_5)_2)_2]_4$ |
| C-32 | $[NP(N(CH_3)C_6H_5)_2]_3$ |
| C-33 | $N_3P_3(C_6H_5)_3(NHCH_3)_3$(cis) |
| C-34 | $N_3P_3(C_6H_5)_3(NHCH_3)_3$(trans) |
| C-35 | $N_3P_3(C_6H_5)_3(NHC_2H_5)_3$(cis) |
| C-36 | $N_3P_3(C_6H_5)_3(NHC_2H_5)_3$(trans) |
| C-37 | $N_3P_3(NHC_2H_5)_4(OCH_2CF_3)_2$(gem) |
| C-38 | $N_3P_3(NHC_2H_5)_4(OCH_2CF_3)_2$(non-gem) |
| C-39 | $N_3P_3(OC_6H_5)_4(NH_2)_2$(gem) |
| C-40 | $N_3P_3(OC_6H_5)_4(NH_2)_2$(non-gem) |
| C-41 | $[NP(NCS)_2]_3$ |
| C-42 | $[NP(N_3)_2]_3$ |
| C-43 | $[NP(OC_3H_7\text{-}n)_2]_3$ |
| C-44 | $[NP(OCH_2CF_3)_2]_3$ |
| C-45 | $[NP(SC_2H_5)_2]_3$ |
| C-46 | $[NP(NH_2)_2]_3$ |
| C-47 | $[NP(CF_3)_2]_4$ |
| C-48 | $[NP(C_6H_5)_2]_4$ |
| C-49 | $[NP(OC_3H_7\text{-}n)_2]_4$ |

-continued
C-50 $[NP(NH_2)_2]_4$
C-51 $[NP(OCH_3)_2]_5$
C-52 $[NP(N(CH_3)_2)_2]_5$
C-53 $[NP(OCH_3)_2]_6$
C-54 $[NP(N(CH_3)_2)_2]_6$
C-55 $[NP(OCH_3)_2]_8$
C-56 $[NP(N(CH_3)_2)_2]_8$
C-57
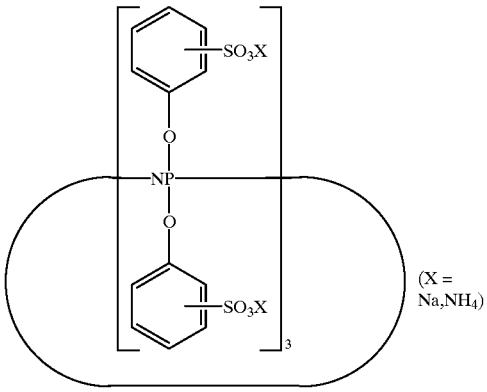
C-58
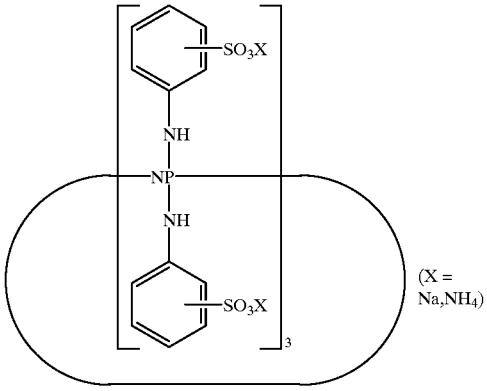

-continued
C-59
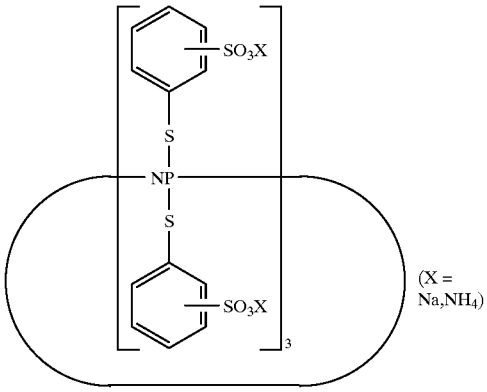
C-60
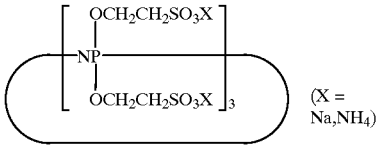
C-61 to C-65
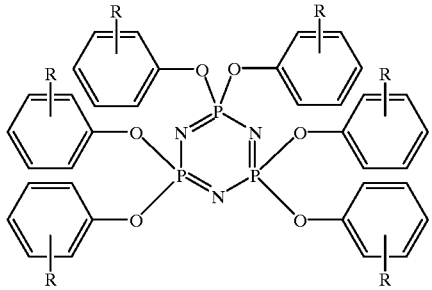
C-66 to C-67
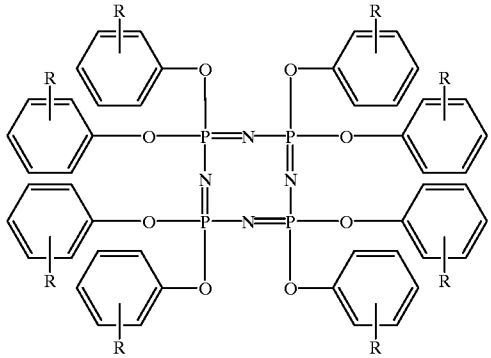
C-68
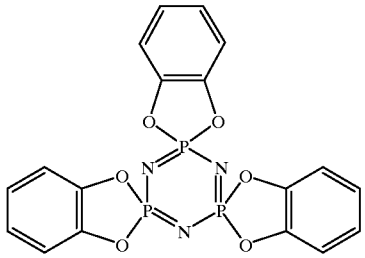

-continued
C-69
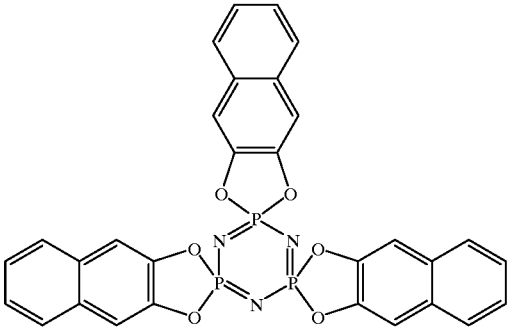
C-70
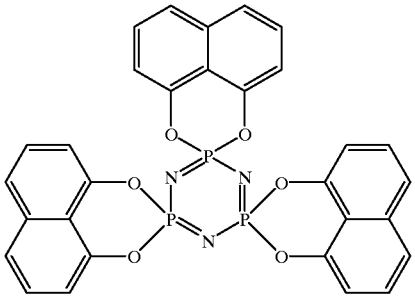
C-71
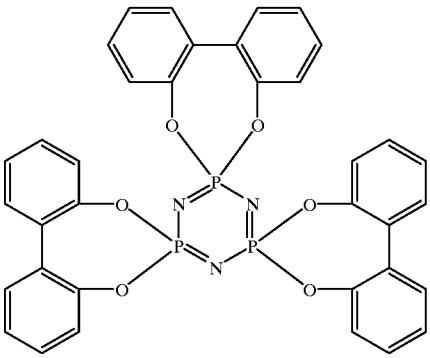
C-72
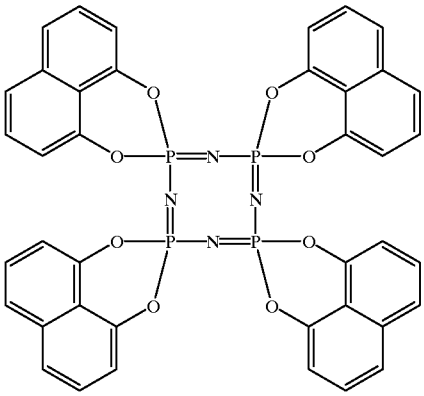

-continued
C-73
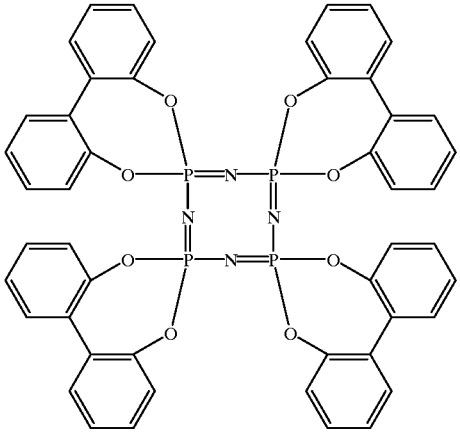
C-74
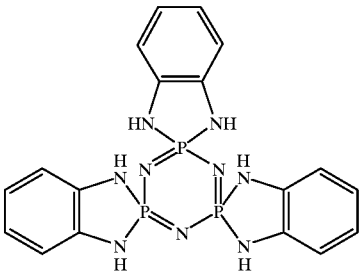
Cyclic chain compound
H-1
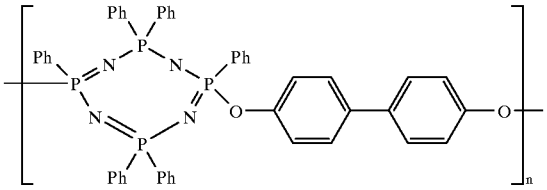
H-2
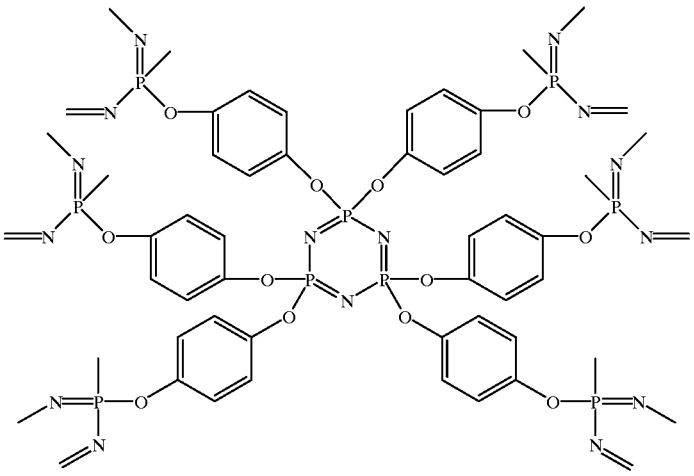

-continued

H-3

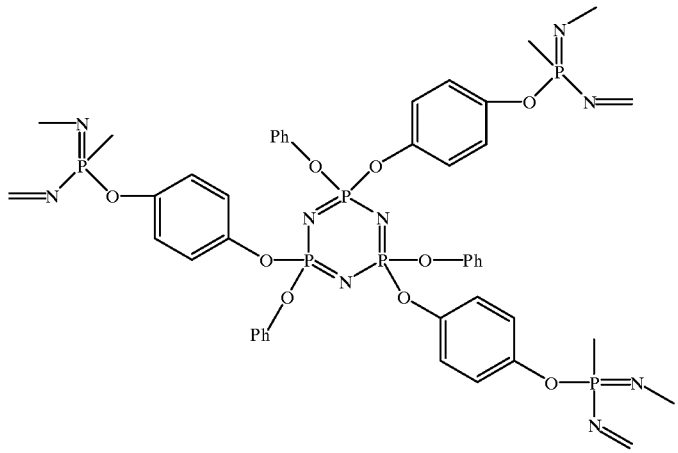

The phosphazene compound may be added to an emulsion coating solution or a coating solution of hydrophilic colloid layer to be adjoined to the emulsion layer to contain the compound in the silver halide emulsion layer or the hydrophilic colloid layer adjoined to the emulsion layer. The addition of the compound may be carried out at any step in the course of from the process of silver halide grain formation to the coating of the coating solution. The adding amount of the compound is preferably from $5\times10^{-4}$ moles to 1 mole, more preferably from $1\times10^{-4}$ moles to $5\times10^{-1}$ moles, of

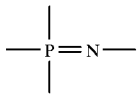

unit per mole of silver halide. When the phosphazene compound is added to the hydrophilic colloid layer adjoined to the silver halide emulsion layer, the amount of the phosphazene compound is similar to that to be added to the silver halide emulsion layer. It is preferred that the compound is added to the silver halide emulsion layer.

The halide composition of the silver halide grain to be used in the silver halide emulsion layer according to the invention, one of silver bromide, silver iodobromide, silver chlorobromide and silver chloroiodobromide is preferred. When the emulsion contains silver iodide, the content of silver iodide is preferably from 0.1 mole-% to 10 mole-%, more preferably from 0.2 mole-% to 2 mole-%.

It is preferable that the silver halide grain relating to the invention is chemically sensitized by a selenium compound and/or a tellurium compound. A known selenium compound such as triphosphine selenide and dimethylselenourea, and a known tellurium compound such as dimethyltellurourea may be used.

The silver halide grains can be sensitized by stirring the emulsion at a high temperature, preferably at a temperature not less than 40° C., for a certain time in the presence of a labile selenium compound and or non-labile selenium compound.

Concrete examples of the labile selenium compound are an isoselenocyanate including an aliphatic isoselenocyanate such as allyl isoselenocyanate, a selenourea, a selenoketone, a selemoamide, a selenocarboxylic acid such as 2-selenolactic acid, a selenoester, a diacyl selenide such as bis[3-chloro-2,6-dimethoxybenzoyl] selenide, a selenophosphate, a phosphine selenide and colloidal metallic selenium.

Concrete examples of the non-labile selenium compound are a selenorous acid, potassium selenocyanide, a selenazole, a quatenary salt of selenazole, a diaryl selenide, a diaryl diselenide, a dialkyl selenide, a dialkyl diselenide, 2-selenazolinedione, 2-selenoxazolinedione and their derivatives.

Examples of the tellurium sensitizer are colloidal tellurium, a tellurourea such as allyltellurourea, N,N-dimethyltellurourea, tetramethyltellurourea, N-carboxyethyl-N'N'-dimethyltellurourea, N,N'-dimethylethylenetellurourea, N,N'-diphenylethylenetellurourea, an isotellurocyanate such as allyl iostellurocyanate, a telluroketone such as telluroacetone and telluroacetophenone, a telluroamide such as telluroacetoasmide and N, N-dimethyltellurobenzamide, a tellurohydrazide such as N, N'-trimethyltellurobenzohydrazide, a telluroester such as t-butyl-t-hexyltelluroester, a phosphine telluride such as tributylphosphine telluride, tricyclohexylphosphine telluride, tri-i-propylphosphine telluride, butyl-di-i-propylphosphine telluride and dibutylphenylphosphine telluride, or another tellurium compound such as a gelatin containing a telluride anion described in British Patent No. 1,295,462, potassium telluride, potassium tellurocyanate, sodium telluropentathionate, and ally tellurocyanate.

The foregoing compound may be added to the emulsion in a form of solution in a proper organic solvent such as ethyl acetate or in a form of solid particle dispersed in water. A method is preferred, in which a small amount of the organic solvent is brought in the emulsion.

The sensitization by the selenium or tellurium sensitizer is preferably performed together with a gold sensitization or a combination of gold sensitization and sulfur sensitization.

In the invention, a tabular silver halide grain having a thickness of from 0.01 $\mu$m to 0.50 $\mu$m and an aspect ratio of from 2 to 50 is preferably used. The tabular silver halide grain usable in the invention is one usually used in the field of the photographic material. Such the tabular silver halide grain is described in the following publications: U.S. Pat. Nos. 4,434,226, 4,439,520,4,433,048, 4,672,027, 4,655,012, 4,679,745, 4,713,320, 4,722,886, 4,755,456, 4,755,671, 4,801,522, 4,806,461, 4,835,095, 4,835,322, 4,914,014, 4,962,015, 4,985,350, 5,061,609, 5,061,616, 5,147,771, 5,147,772, 5,147,773, 5,17,1659, 5,300,413, 5,310,644, 5,314,793, 5,334,495, 5,358,840, and 5,372,927.

The tabular grain has parallel major surfaces facing to each other and the major surfaces are each (111) face. The circle equivalent diameter is preferably from 0.5 μm to 3.0 μm, more preferably from 0.5 μm to 2.0 μm. The thickness of the grain is preferably from 0.01 μm to 0.5 μm, more preferably from 0.1 μm to 0.3 μm. The aspect ratio defined by circle equivalent diameter/thickness is preferably from 2 to 50, more preferably from 5 to 30.

The circle equivalent diameter means an average projection area diameter, hereinafter referred to grain diameter, which is defined by the diameter of a circle having the same area as the projection area of the grain. The thickness of the grain is a distance between two parallel major faces of the grain.

In the invention, a tabular emulsion is preferably a monodisperse emulsion having a narrow grain diameter distribution. In concrete, an emulsion having a width of grain diameter distribution defined below is not more than 25%, preferably not more than 20%, more preferably not more than 15%, is preferably used.

(Standard deviation of grain diameter/Average diameter)×100=Width of grain diameter distribution The tabular grain is crystallographically classified to a twined crystal. The twin crystal is a crystal having one or more twin face in a crystal. The classification of the shape of twin crystal is described in detail by Klein and Moiser in "Photographicshe Korrespondenz" vol. 99, p.90, and vol. 100, p. 57.

The tabular grain may has a protuberance portion. Although the protuberance may be formed on the major surface or an outlying portion of the grain, the protuberance is preferably formed at the outlying portion of the grain. The edge portion of the grain is an area surrounded by the outline of the grain and a line apart from the outline by a distance of 10% of the circle equivalent diameter of the grain.

The silver halide composition of the protuberance is preferably one of silver bromide, silver iodobromide, silver chlorobromide and chloroiodobromide. When silver iodide is contained, the iodide content is preferably from 0.1 mole-% to 13 mole-%, more preferably from 0.1 mole-% to 10 mole-%.

In the invention, the silver halide emulsion may has a dislocation. The dislocation can be directly observed by a penetration type electron microscope at a low temperature according to the description of J. F. Hamilton, Phot. Sci. Eng., 57, 1967, and T. Shiozawa, J. Soc. Phot. Sci. Japan, 35, 213, 1972. A grain carefully taken from the emulsion so that no dislocation is newly formed, is put on a mesh for electron microscope observation and observed by penetration method under a cooled condition to prevent the damage such as printout by electron rays. A clear observation can be attained by a high voltage type electron microscope since the electron rays become difficultly penetrate through the grain when the thickness of the grain is thicker. The voltage is preferably 200 kV or more to a grain having a thickness of 0.25 μm.

In the invention, the tabular silver halide grain may contains a metal ion internal and/or external portion thereof by adding a metal compound selected from a cadmium salt, a zinc salt, a lead salt, a thallium salt, an iridium salt and its complex, a rhodium salt and its complex, and an iron salt and its complex, in the process of grain formation and/or growing.

In the method of the invention, the developing solution and/or the fixing solution may be contains a phosphazene compound. The phosphazene compound is preferably one represented by Formula 3 or 4. The amount of the phosphazene compound represented by Formula 3 or 4 is preferably within the range of from $2\times10^{-6}$ moles to 2 moles, more preferably from $2\times10^{-4}$ moles to $2\times10^{-1}$ moles, of

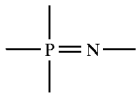

unit per liter of the processing solution. When the compound to be added to the processing solution is preferably one soluble in water or an alkaline solution.

The developing solution to be used in the processing according to the invention preferably further contains a compound represented by the following Formula A, B, C, D or E. The fluctuation of the sensitivity of the light-sensitive material in the course of running of the processing and the for mation of sludge in the developing solution can be reduced by the addition of the compound represented by Formula A, B, C, D or E.

Formula A

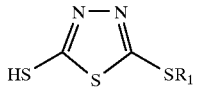

In Formula A, $R_1$ is a hydrogen atom, an alkyl group having 1 to 6 carbon atoms, or an aminoalkyl group, a dialkylaminoalkyl group or a carboxylalkyl group each having an alkyl moiety having 1 to 6 carbon atoms. Examples of compound represented by Formula A is shown below.

Among them, A-1 is most preferable.

A-1

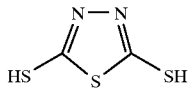

A-2

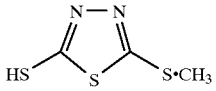

A-3

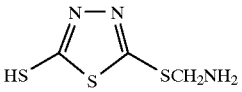

A-4

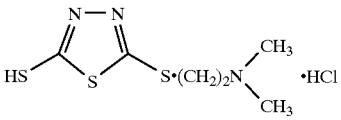

A-5

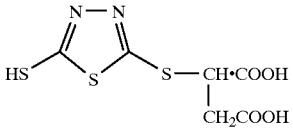

Formula B

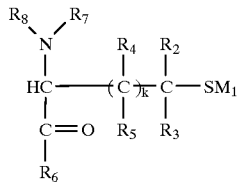

In Formula B, $R_2$ and $R_3$ are each a hydrogen atom or an alkyl group having 1 to 3 carbon atoms such as a methyl group, ethyl group and propyl group, provided that at least one of $R_2$ and $R_3$ is the alkyl group. $R_4$ and $R_5$ are each a hydrogen atom or an alkyl group having 1 to 3 carbon atoms such as a methyl group, ethyl group and propyl group. $R_6$ is a hydroxyl group including its metal salt, an amino group, or an alkyl group having 1 to 3 carbon atoms such as a methyl group, ethyl group and propyl group. $R_7$ and $R_8$ are each a hydrogen atom, an alkyl group having 1 to 5 carbon atoms such as a methyl group, ethyl group and propyl group, an acyl group having 18 or less, usually 2 to 18, carbon atoms such as acetyl group and poropionyl group, or a —$COOM_{10}$ group, in which $M_{10}$ is a hydrogen atom, an alkyl group having 1 to 4 carbon atoms, an alkali metal atom, an aryl group, or an alkyl group having 15 or less, usually 7 to 15, carbon atoms, provided that at least one of $R_7$ and $R_8$ is the above-defined group other than hydrogen atom. $M_1$ is a hydrogen atom, an alkali metal atom or an ammonium group. k is 0, 1 or 2.

Examples of the compound represented by Formula B are shown below.

B-1

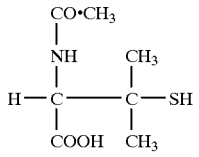

B-2

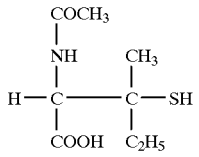

B-3

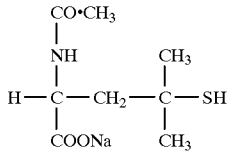

B-4

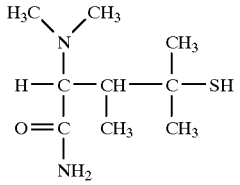

Formula C

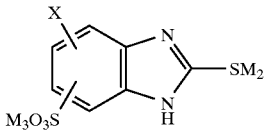

In Formula C, X is a hydrogen atom, a hydroxyl group, an alkyl group having from 1 to 5 carbon atoms, an alkoxyl group having from 1 to 5 carbon atoms, a halogen atom, a carboxyl group or a sulfo group. $M_2$ and $M_3$ are each a hydrogen atom, an alkali metal atom or an ammonium group, $M_2$ and $M_3$ may be the same or different.

Examples of the compound represented by Formula C are shown below, in which C-1 is most preferable.

C-1

C-1

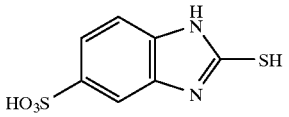

C-2

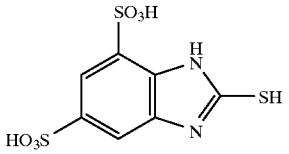

Formula D

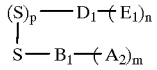

In Formula D, $D_1$ and $B_1$ are each independently an alkylene group, which may have a substituent, such as methylene group, ethylene group, dimethylethylene group, phenylethylene group and methylphenylethylene group. $E_2$ and $A_2$ are each independently a —COOM group, an —$SO_2M$ group, an —OM group, an —SZ group, an —$SO_2N(X_1)(Y_1)$ group or a —$CO(X_1)(Y_1)$ group. In the above, M is a cation such as $H^+$, and $X_1$ and $Y_1$ are each a hydrogen atom, a hydroxyl group, an alkyl group or phenyl group each may be substituted by a sulfo group or a carboxyl group, or a sulfonyl group which may be substituted by a phenyl group. Z is a hydroxyl group, an alkyl group or phenyl group each may be substituted by a sulfo group or a carboxyl group, or a sulfonyl group which may be substituted by a phenyl group. p is 1 or 2, and m and n is an integer of 1, 2 or 3.

Examples of the compound represented by Formula D are shown below.

D-1

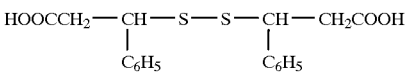

-continued

D-2

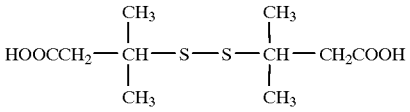

D-3

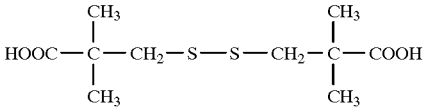

D-4

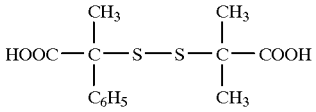

Formula E

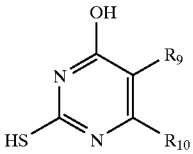

In Formula E, $R_9$ and $R_{10}$ are each a hydrogen atom, an alkyl group, which may have a substituent, such as methyl group, ethyl group, propyl group, morpholinomethyl group, 4-methylpiperadyl group and diaminomethyl group, an aryl group such as phenyl group, an aralkyl group, a hydroxyl group, a mercapto group, a carboxyl group, a sulfo group, a phosphono group, an amino group, a nitro group, a cyano group, a halogen atom, an alkoxyl group, an alkoxycarbonyl group, an aryloxycarbonyl group, a carbamoyl group, a sulfamoyl group or a heterocyclic group. $R_9$ and $R_{10}$ may be linked with together to form a ring such as cyclohexene.

Examples of the compound represented by Formula E are shown below.

E-1

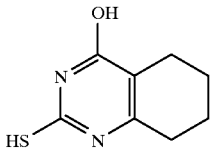

E-2

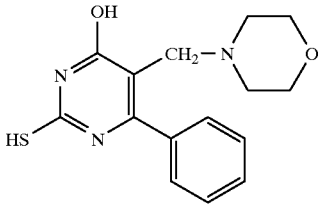

-continued

E-3

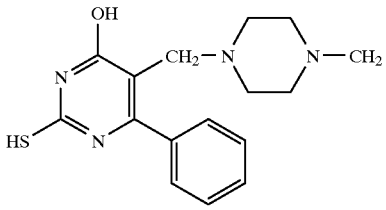

E-4

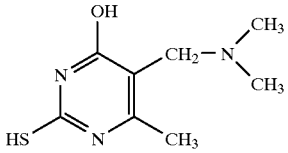

The compound represented by Formula A, B, C, D or E may be used singly or in combination of two or more kinds thereof. The adding amount to the developing solution is preferably from $1\times10^{-5}$ moles to $1\times10^{-2}$ moles, more preferably from $1\times10^{-4}$ moles to $2\times10^{-3}$ moles, per liter.

In the developing solution to be used in the processing according to the invention, a reductone is preferably used as the developing agent. The reductone is preferably a compound represented by Formula 1. The reductone is typically ascorbic acid, erythorbic acid and their derivative. These compounds are available on the market or easily synthesized by a know synthetic method.

The using amount of ascorbic acid, erythorbic acid or their derivative is preferably from 0.05 g to 120 g, more preferably from 10 g to 60 g, further preferably from 40 g to 50 g, per liter of the developing solution.

As an assistance developing agent capable of showing a super additivity with the reductone developing agent, a 3-pyrazolidone derivative and a p-aminophenol derivative are usable. Although concrete examples of the assistance developing agent are shown below, usable assistance developing agent is not limited thereto: 1-phenyl-3-pyrazolidone, 1-phenyl-4-methyl-4'-hydroxymethyl-3-pyrazolidone, 1-phenyl-5-methyl-3-pyrazolidone, 1-p-aminophenyl-4,4'-dimethyl-3-pyrazolidone, 1-p-tolyl-4,4'-dimethyl-3-pyrazolidone, 1-p-tolyl-4-methyl-4'-hydroxymethyl-3-pyrazolidone,, N-methyl-p-aminophenol, N-(β-hydroxyethyl)-p-aminophenol, N-(4-hydroxyphenyl) glycine, 2-methyl-p-aminophenol, and p-benzylaminophenol.

In the processing method according to the invention, a dihydroxybenzene type developing agent is usable.

Examples of the dihydroxybenzene type developing agent includes hydroquinone, chlorohydroquinone, bromohydroquinone, iso-propylhydroquinone, methylhydroquinone, 2,3-dichlorohydroquinone, 3,5-dichlorohydroquinone, 2,3-dichlorohydroquinone and 2,5-dimethylhydroquinone. Among them, hydroquinone has been used most usually.

In the invention, the developing solution and the fixing solution may be replenished by a developing solution replenisher and a fixing solution replenisher, respectively. Although there is no limitation on the rate of replenisher, a rate of from 30 ml to 180 ml per square meter of light-sensitive material is preferred, and a rate of from 30 ml to 100 ml per square meter is more preferable for both of the developing solution and the fixing solution.

In the developing solution, a sulfite or an organic reducing agent may be used as a preservant, and a chelating agent and a adduct of a hardener and a bisulfite salt are also usable. Furthermore, a silver sludge preventing agent, a cyclodextrin compound, and an amine compound are preferably added to the developing solution.

In the developing solution, a buffering agent is used. Examples of the buffering agent are as follows: sodium carbonate, sodium bicarbonate, potassium bicarbonate, trisodium phosphate, tripotassium phosphate, dipotassium phosphate, sodium borate, potassium borate, sodium tetraborate, potassium tetraborate, sodium salicylate, potassium salicylate, sodium 5-sulfosulcylate and potassium 5-sulfosulcylate.

A thioether compound, a p-phenylenediamine compound, a quatenary ammonium salt, a p-aminophenol, an amine compound, a polyethylene oxide compound, a hydrazine compound, a mesoionic compound, an ionic compound or a imidazole compound may be added to the developing solution as a developing accelerating agent according to necessity.

An alkali metal halide such as potassium iodide, and an organic antifoggant such as benztriazole, 6-nitrobenzimidazole, 5-nitrobenzimidazole, 5-methylbezimidazole, 5-nitrobenzotriazole, 5-chlorobenzotriazole, 2-thiazolylbenzimidazole, 2-thiazolylmethylbenzimidazole, indazole, hydroxyazaindolidine and adenine are usable as an antifoggant.

In the developing composition, an organic solvent such as methyl cellosolve, methanol, acetone, dimethylformamide, a cyclodextrin compound and a compound described in Japanese Patent Nos. 47-33378 and 44-9509 are usable to raise the solubility of the developing agent. A stain preventing agent, sludge preventing agent, an interlayer effect accelerating agent are also may be used.

In the fixing solution, known compounds such as a fixing agent, a pH buffering agent, a preservant and a water softening agent may be used, for example compounds described in JP O.P.I. Nos. 4-242246 and 5-113632 are usable.

A thiosulfate and thiocyanate are usually used as the fixing agent.

The processing method according to the invention is advantageously applied to the processing by an automatic processor having a mechanism for supplying a solidified processing composition.

When the processing composition is supplied in a form of tablet, a processing composition supplying means described in Japanese Utility Model Publication Open for Public Inspection, hereinafter referred to JU O.P.I., Nos. 63-137783, 63-97522 and 1-85732 can be referred. When the developing composition is supplied in a form of granule or powder, a supplying means using falling by gravity described in JU O.P.I. Nos. 62-81964, 63-84151, and 1-292375, and a means using a screw or auger described in JU O.P.I. Nos. 63-105159 and 63-195345 can be referred. The solidified processing composition is supplied into the processing tank. The composition is preferably supplied at a position which is connected to the processing tank for processing the light-sensitive material so that the processing solution is circulated the position and the processing tank. It is further preferable that the portion at which the solidified processing composition to be supplied has a structure so that a certain amount of processing solution is circulated through the portion and the dissolved composition is moved to the processing tank. The solidified processing composition is preferably supplied into the processing solution maintained at the processing temperature.

Although the whole processing time for dry to dry is not specifically limited in the processing according to the invention, the processing is performed preferably within the time of from 15 seconds to 90 seconds, more preferably from 15 seconds to 45 seconds, further preferably from 15 seconds to 30 seconds, using an automatic processor. The development is preferably performed for a time of from 3 seconds to 25 seconds more preferably from 3 seconds to 10 seconds, at a temperature of from 25° C. to 50° C., preferably from 30° C. to 40° C. The fixing is preferably performed for a time of from 2 seconds to 12 seconds, more preferably from 2 seconds to 10 seconds, at a temperature of from 20° C. to 50° C., more preferably from 30° C. to 40° C. The washing or stabilizing is preferably performed at a temperature of from 2 seconds to 15 seconds, more preferably from 2 seconds to 8 seconds at a temperature of from 0° C. to 50° C., more preferably from 15° C. to 40° C. The drying is preferably performed at a temperature of from 3 seconds to 12 seconds, more preferably from 3 seconds to 8 seconds at a temperature of from 35° C. to 100° C., more preferably from 40° C. to 80° C. After the developing, fixing and washing, the light sensitive material is dried after removing water remained on the light-sensitive material by a squeezing roller. In the above-mentioned, the developing time is defined by the period of from the moment at which the front of the light-sensitive material is immersed to the developing solution in the developing tank to the time at which the front of the light-sensitive material is contacted to the fixing solution of the next processing step. Similar to that, the fixing time is defined by the period of from the moment at which the light-sensitive material is immersed in the fixing solution to the moment at which the light-sensitive material contacted to the liquid in the washing or stabilizing tank, and the washing time is defined by the period in which the light-sensitive material is immersed in the washing or stabilizing tank. The drying time is the period in which the light-sensitive material is existed in the drying zone of the automatic processor.

EXAMPLES

Example 1

<Preparation of seed emulsion 1>

A seed emulsion 1 was prepared as follows.

| | |
|---|---|
| Solution A1 | |
| Ossein gelatin | 24.2 g |
| Water | 9657 ml |
| Sodium polypropyreneoxy-polyethyleneoxy-disuccinate, 10% ethanol solution | 6.78 ml |
| Potassium bromide | 10.8 g |
| 10% nitric acid | 114 ml |
| Solution B1 | |
| 2.5 N silver nitrate aqueous solution | 2825 ml |
| Solution C1 | |
| Potassium bromide | 841 g |
| water to make | 2825 ml |
| Solution D1 | |
| 1.75 N potassium bromide aqueous solution An amount necessary to maintain the silver electrode potential | |

To Solution A1, 464.3 ml of Solution B1 and the same amount of Solution C1 were added by a double-jet method spending 1.5 minutes at 42° C. using a mixing apparatus described in Japanese Patent No. 58-58288 and 58-58289 to form nuclei.

After stopping the addition of Solutions B1 and C1, the temperature of Solution Al was raised by 60° C. spending 60 minutes and the pH of the solution was adjusted to 5.0 using a 3% solution of KOH. Then Solutions B1 and C1 were added by a double-jet method at a flow rate of 55.4 ml/minute spending 42 minutes. The silver electrode potentials of the mixture during the period of temperature rising from 42° C. to 60° C., and that of the addition of Solutions B1 and C1 were each maintained at +8 mV and +16 mV, respectively, by the use of Solution D.

After completion of the addition, the pH of the emulsion was adjusted to 6 and the emulsion was subjected to desalting and washing. It is confirmed by electron microscopic observation that the sum of projection area of tabular hexagonal grains having the maximum adjoining edge ratio of from 1.0 to 2.0 accounts for 90% of the sum of projection area of whole grains contained in the thus obtained seed emulsion. The average thickness and the average circle equivalent diameter of the tabular hexagonal grains were each 0.064 μm and 0.595 μm, respectively. The variation coefficient of the thickness was 40% and that of twin face distance was 42%.

<Preparation of Emulsion 1>

A tabular grain silver halide emulsion, Emulsion 1, was prepared using the following four solutions.

| | |
|---|---|
| Solution A2 | |
| Ossein gelatin | 34.03 g |
| Sodium polypropyleneoxy-polyethyleneoxy-disuccinate | 2.25 ml |
| Seed emulsion 1 | 1.722 moles in terms of silver halide |
| Water to make | 3150 ml |
| Solution B2 | |
| Potassium bromide | 1734 g |
| Water to make | 3644 ml |
| Solution C2 | |
| Silver nitrate | 2478 g |
| Water to make | 4165 ml |
| Solution D2 | |
| Fine grain emulsion composed of 3% by weight of gelatin and silver iodide grains having an average diameterof 0.05 μm* | 0.080 moles in terms of silver halide |

*: The silver iodide fine grain emulsion was prepared as follows: To 6.64 liter of an aqueous solution containing 5.0 wt % of gelatin and 0.06 moles of potassium iodide, 2 liter of a solution containing 7.06 moles of silver nitrate and the same amount of a solution containing 7.06 moles of potassium iodide were added spending 10 minutes. During the formation of the grains, the pH of the mixture was maintained at 2.0 by the use of nitric acid and the temperature was adjusted to 40 C. After formation of the grains, the pH was adjusted to 6.0 by the use of sodium carbonate solution.

Solution A2 was vigorously stirred in a reaction vessel while maintaining at 60° C., and a part of Solution B2, a part of Solution C2 and a half of Solution D2 were added to Solution A2 by a double-jet method spending 5 minutes. Then a half of remained Solution B2 and a half of remained Solution C2 were added for 37 minutes. After that, a part of remained Solution B2, a part of remained Solution C2 and all of the remained Solution D2 were added spending 15 minutes. At last, all of the remained Solution B2 and remained Solution C2 were added spending 33 minutes. The pH and pAg of the emulsion were maintained during the addition at 5.8 and 8.8, respectively. The adding flow rates of Solutions B2 and C2 were functionally controlled with respect to the mixing time so as to corresponding to the critical growing rate of the grains.

After completion of the addition, the emulsion was desalted by a known ultrafiltration and redispersed by addition of 10% gelatin solution and stirring for 30 minutes at 50° C. The pH and pAg of the emulsion was adjusted to 5.80 and 8.06, respectively, at 40° C.

It is confirmed by electron microscopic observation that the silver halide grains of thus obtained emulsion have an average diameter of 1.22 μm, an average thickness of 0.15 μm, an average aspect ratio of approximately 8.1 and a grain size distribution width of 18.1%. The average twin face distance of the grains was 0.020 μm. In the emulsion, grains having a ratio of the twin face distance to the grain thickness of 5 or more accounted for 97% of the whole tabular silver halide grains in number, and grains having the ratio of not less than 10 accounted for 49%, and grains having the ratio of not less than 15 accounted for 15%.

Pure water was added to the obtained Emulsion 1 so that the volume of the emulsion was to be 300 ml per mole of silver halide and heated by 50° C. Then 20 mg of benzyladenine was added to the emulsion. After 10 minutes, 0.6 moles of sensitizing dye A and 0.006 moles of sensitizing dye B were added in a form of solid particle dispersions to the emulsion. After 10 minutes of the addition of the sensitizing dyes, $3\times10^{-3}$ moles of ammonium thiocyanate, a appropriate amount of chloroauric acid and sodium thiosulfate were added to the emulsion. Before 60 minutes of the completion of the chemical sensitization, 4 g of silver iodide fine grains and 2 g of triphenylphosphine selenide dispersion. At the completion of the chemical sensitization, 4-hydroxy-6-methyl-1,3,3a,7-tetrazaindene, TAI, was added.

The forgoing dispersion of triphenylphosphine selenide was prepared as follows. To 30 kg of ethyl acetate, 120 g of triphenylphosphine selenide was added and stirred to be completely dissolved at 40° C. Besides, 308 kg of photographic use gelatin was dissolved in 38 kg of pure water, and 93 g of a 25 wt-% solution of sodium dodecylbenzenesulfonate was added to the solution. Then the two solutions were mixed and dispersed at 50° C. for 30 minutes by a high speed stirring type dispersing machine having a dissolver with a diameter of 10 cm at a circumference speed of the dispersing propeller of 40 m/second. Then ethyl acetate was rapidly removed from the dispersion until the remaining concentration of ethyl acetate was become by 0.3 wt-% or less by stirring under a vacuum. The dispersion was diluted by pure water to make 80 kg. A part of thus obtained dispersion was used in the foregoing experiment.

An emulsion layer coating solution was prepared by addition the later-mentioned additives to the above-mentioned Emulsion 1. The pH and silver electrode potential of the emulsion coating solution was adjusted to 6.20 and 80 mV at 35° C., respectively, using a solution of sodium carbonate and that to potassium bromide.

A sample was prepared using the coating solution. The emulsion layer coating solution was coated so that the coating amount of silver was 1.8 g/m$^2$ and that of gelatin was 1.7 g/m$^2$ per one side of the sample.

A protective layer coating solution was prepared using the following additives. The protective layer solution was simultaneously coated together with the above-prepared emulsion layer coating solution on the both sided of a support by two slide hopper coaters at a speed of 80 m/minute so that the gelatin amount of the protective layer was 0.7 g/m$^2$. The coated sample was dried for 2 minutes 20 seconds.

The following spectral sensitizing dyes were used.

Spectral sensitizing dye A:

Sodium salt of 5,5'-dichloro-9-ethyl-3,3'-di-(3-sulfopropyl)-oxacarbocyanine anhydride Spectral sensitizing dye B:

Sodium salt of 5,5'-di-(butoxycarbonyl)-1,1'-diethyl-3,3'-di-(4-sulfobutyl)-benzimidazolocarbocyanine anhydride The additives used in the emulsion layer were as follows. The adding amount is referred in terms of per mole of silver halide.

| | |
|---|---|
| 1,1-dimethylol-1-brom-1-netromethane | 10 mg |
| t-butylcatechol | 70 mg |
| Polyvinylpyrrolidone, molecular weight: 10,000 | 1.0 g |
| Styrene/maleic anhydrous copolymer | 2.0 g |
| Nitrophenyl-triphenylphosphonium chloride | 5.0 mg |
| Ammonium 1,3-dihydroxybenzene-4-sulfonate | 2.0 g |
| Sodium 2-mercaptobenzimidazole-5-sulfonate | 1.5 mg |
| $C_4H_9OCH_2CH(OH)CH_2N(CH_2COOH)_2$ | 1.5 g |
| 1-phenyl-5-mercaptotetrazole | 15 mg |
| Methacrylic acid/ethyl methacrylate copolymer | 18 g |
| 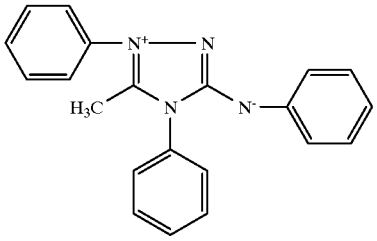 | 150 mg |
| 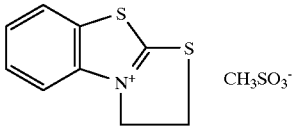 | 70 mg |
| Trimethylolpropane | 10 mg |
| 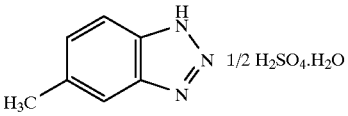 | 500 mg |
| 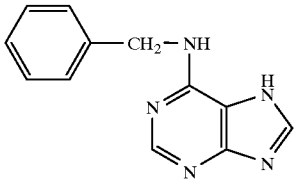 | 100 mg |

The additives used in the protective layer coating solution were shown below. The amount of the additives is described in terms of per liter of the solution.

| | |
|---|---|
| Lime-processed inert gelatin | 58 g |
| Acid-processed gelatin | 2 g |
| Sodium i-amyl-n-decylsulfosuccinate | 1.0 g |
| Polymethyl methacrylate, a matting agent having an area average diameter of 3.5 μm | 0.4 g |
| Silicon dioxide, a matting agent having an area average diameter of 1.2 μm | 0.7 g |
| Ludox MA, colloidal silica produced by du Pont Co., Ltd. | 3.0 g |
| Surfactant a | 1.0 g |

-continued

| | |
|---|---|
| 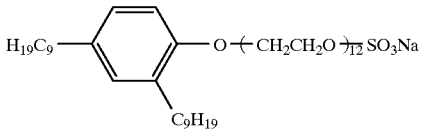 | |
| Surfactant b | 0.4 g |
| 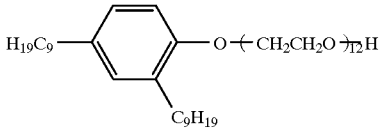 | |
| Surfactant c | 2.5 g |
| $H_{23}C_{11}CONH(CH_2CH_2O)_5H$ | |
| Hardener | 10 g |
| 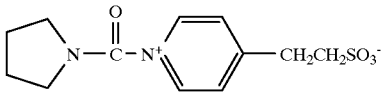 | |
| Bis-vinylsulfonylmethyl ether | 0.4 g |

The phosphazene compound relating to the invention and the compound represented by Formula 1 or 2 were added as described in Table 1.

The samples thus prepared were processed by Automatic Processor TCX-201, manufactured by Konica Corporation, which was modified so that the processing time for dry to dry was to be 40 seconds. In the processing, the following developing solution was used. The temperature of the developing solution and fixing slution was 35° C., and that of the washing water was 20° C. the rpenishing rate of the developing solution and fixing solution was 100 ml per $m^2$ of processed light-sensitive material. The phosphazene compound relating to the invention was added as shown in Table 2.

Preparation of tableted developer reprenisher composiotion

A tableted developer replenisher composition was prepared by the following Procedures A and B.

Procedure A

In a bandom mill, 12,500 g of sodium erythorbate was powdered so that the average size was become 10 μm. To the fine powder thus obtained, 2,000 g of sodium sulfite, 2,700 g of 1-phenyl-4-hydroxymethyl-4-methyl-3-pyrazolidone, 12.5 g of pentasodium diethylenetriaminepentaacetate, 12.5 g of 5-methylbezotiazole and 4 g of 1-phenyl-5-mercaptotetrazole were added and mixed in the mill for 30 minutes. To the mixture, 30 ml of water was added, and the mixture was granuled in a stirring granulation apparatas available on the market. Then the granules thus obtained were dried in a fluid layer drying apparatus at 40° C. for 2 hours to almost completely remove moisture from the granules. To the dried glanules, 1,670 g of polyethylene glycol #6000 and 1,670 g of mannitol were added and mixed in a mixer installed in a room conditioned at a temperature of 25° C. and a relative humidity of not more than 40° C. Thus obtained mixture was tableted by a tableting machine, modified Toughpresscorrect 1527HU manufactured by Kikusui Seisakusyo Co., Ltd., in a rate of 8.77 g per tablet. Thus 2,500 tablets of developer replenisher composition A was prepared.

Procedure B

In a manner similar to that in the procedure A, 4,000 g of potassium carbonate, 2,100 g of mannitol and 2,100 g of polyethylene glycol #6000 were powdered and granuled. The amount of water added for granualtion was 30 ml. Then granules were dried at 50° C. for 30 minutes to almost completely remove moisture from the granules. The mixture thus obtained by the foregoing tableting machine in a rate of 3.28 g per tablet. Thus 2,500 tablets of developer replenisher composition B was prepared.

To prepare a developer replenisher solution, 26 tablets of the developin composition tablet A and 26 tablets of the developin composition tablet B were dissolved in water and made up to 1 liter.

To prepare an intitial developing solution to be charged in the developing tank at the start of of processing, acetic acid in an amount of necessary to adjust the pH value to 10.00 and 12.2 g/l of potassium bromide was added to the developer replenisher solution.

Preparation of tableted fixer repelenisher composition

A tableted fixer repelenisher composition was prepared by the following procedure C and D.

Procedure C

In a manner similar to that in the foregoing procedure A, 14,000 g of a mixture of ammonium thiosulfate and sodium thiosulfate with a mixing ratio of 70/30, 1,500 g of sodim sulfite were powdered and mixed in a mixer available on the market. The mixture was granuled with 500 ml of water. Then the granules were dried at 60° C. for 30 minutes to almost competely remove moisture from the granules. Tor thus obtained granules, 4 g of sodium N-lauroylalanine was added and mixed for 3 minutes by a mixture in a room conditioned at a temperature of 25° C. and a relative humidity of mot more than 40° C. The mixture was tableted by the foregoing tableting machine in a rate of 6.202 g per tablet. Thus 2500 tablet of fixer prepnisher composition C were prepared.

Procedure D

In a manner similar to that in the foregoing procedure A, 1,000 g of boric acid, 1,500 g of aluminum sulfate 18-hydrate, 3,00 g of sodium hydrogen acetate, a dried equimolar mixture of sodium acetate and glacial acetic acid, 200 g of tartaric acid were powdered, and granules. The amount of water for granulation was 100 ml. To the granules, 4 g of sodium N-lauroylalanine was added and mixed for 3 minutes. The mixture thus obtained was tableted by the foregoing tableting machine in a rate of 4.562 g per tablet. Thus 1250 tablet of fixer replenisher composition D were prepared.

To prepare a fixer replenisher solution, 4 tablets of the fixer repenisher composition C and 3 tablts of the fixer replenisher composition D were dissolved in water and made up to 1 liter. The fixer replenisher solution is also used as the initial tank fixing solution.

The development and fixing were performed at 35° C., and the temperature of the washing water was 20° C. The replenishing rates of the developing solution and the fixing solution were each 100 ml per 1 $m^2$ of the light-sensitive material. The phosphazene compound relating to the invention was added to the developing solution as described in Table 1.

<Evaluation of running stability>

The processing was run using the samples having a size of 35 cm×35 cm which is uniformly exposed to light so that a density of 1.0 was formed after processing. In the course of the running, 150 sheets per day of the light-sensitive material were processed, and the sensitometric property and the tone of silver image of the samples were evaluated at the initial time of the running, after processing of 750 sheets or 5 days, and after processing of 1500 sheets or 10 days. Results of the evaluation are shown in Table 2.

<Sensitometric property>

The sample was put between two sheets of fluorescent intensifying screen SOR-250, manufactured by Konica Corporation, and exposed to X-ray under conditions of a bulb voltage of 90 kVp, an electric current of 100 mA and a time of 0.05 seconds. A sensitometric curve was drawn by the distance changing method. The sensitivity was defined by the reciprocal of the amount of X-ray necessary to form a density of 1.0 on the fog density.

<Tone of silver image>

Sample was uniformly exposed to light so that an image having a density of 1.2 was formed after processing and processed. The processed sample was visually observed on a back-light viewer and the tone of the image was classified to four ranks according to the following norm.

4: Bluish pure black

3: Slightly bluish black

2: Slightly yellowish black

1: Yellowish black

TABLE 1

| | Phosphazene compound | | | Compound of Formula 1 | | | Compound of Formula 2 | | |
|---|---|---|---|---|---|---|---|---|---|
| Sample No. | Examplified compound | Layer | Amount ($mg/m^2$) | Examplified compound | Layer | Aamount (Moles/mole of Agx) | Examplified compound | Layer | Aamount (Moles/mole of AgX) |
| 1 | — | — | — | — | — | — | — | — | — |
| 2 | C-22 | Prot. | 100 | — | — | — | — | — | — |
| 3 | C-22 | Prot. | 100 | 1-1 | Prot. | $2.5 \times 10^{-4}$ | — | — | — |
| 4 | C-22 | Prot. | 1000 | 1-1 | Prot. | $2.5 \times 10^{-4}$ | — | — | — |
| 5 | C-22 | Prot. | 10 | 1-1 | Prot. | $2.5 \times 10^{-4}$ | — | — | — |
| 6 | C-22 | Prot. | 100 | 1-1 | Emul. | $2.5 \times 10^{-4}$ | — | — | — |
| 7 | C-22 | Emul. | 100 | 1-1 | Prot. | $2.5 \times 10^{-4}$ | — | — | — |
| 8 | C-22 | Emul. | 100 | 1-1 | Emul. | $2.5 \times 10^{-4}$ | — | — | — |
| 9 | C-22 | Prot. | 100 | — | — | — | 2-1 | Prot. | $2.5 \times 10^{-4}$ |
| 10 | C-22 | Prot. | 1000 | — | — | — | 2-1 | Prot. | $2.5 \times 10^{-4}$ |
| 11 | C-22 | Prot. | 10 | — | — | — | 2-1 | Prot. | $2.5 \times 10^{-4}$ |
| 12 | C-22 | Prot. | 100 | — | — | — | 2-1 | Emul. | $2.5 \times 10^{-4}$ |
| 13 | C-22 | Emul. | 100 | — | — | — | 2-1 | Prot. | $2.5 \times 10^{-4}$ |
| 14 | C-22 | Emul. | 100 | — | — | — | 2-1 | Emul. | $2.5 \times 10^{-4}$ |
| 15 | C-22 | Prot. | 100 | 1-1 | Prot. | $2.5 \times 10^{-4}$ | 2-1 | Prot. | $2.5 \times 10^{-4}$ |
| 16 | C-22 | Emul. | 100 | 1-1 | Emul. | $2.5 \times 10^{-4}$ | 2-1 | Emul. | $2.5 \times 10^{-4}$ |
| 17 | C-22 | Prot. | 100 | 1-2 | Prot. | $2.5 \times 10^{-4}$ | — | — | — |
| 18 | C-22 | Prot. | 100 | 1-17 | Prot. | $2.5 \times 10^{-4}$ | — | — | — |

TABLE 1-continued

| Sample No. | Phosphazene compound: Exampli-fied compound | Phosphazene compound: Layer | Phosphazene compound: Amount (mg/m$^2$) | Compound of Formula 1: Exampli-fied compound | Compound of Formula 1: Layer | Compound of Formula 1: Aamount (Moles/mole of Agx) | Compound of Formula 2: Exampli-fied compound | Compound of Formula 2: Layer | Compound of Formula 2: Aamount (Moles/mole of AgX) |
|---|---|---|---|---|---|---|---|---|---|
| 19 | C-22 | Prot. | 100 | — | — | — | 2-2 | Prot. | $2.5 \times 10^{-4}$ |
| 20 | C-22 | Prot. | 100 | — | — | — | 2-3 | Prot. | $2.5 \times 10^{-4}$ |
| 21 | L-18 | Emul. | 100 | 1-1 | Emul. | $2.5 \times 10^{-4}$ | — | — | — |
| 22 | L-22 | Emul. | 100 | 1-1 | Emul. | $2.5 \times 10^{-4}$ | — | — | — |
| 23 | C-39 | Emul. | 100 | 1-1 | Emul. | $2.5 \times 10^{-4}$ | — | — | — |
| 24 | H-3 | Emul. | 100 | 1-1 | Emul. | $2.5 \times 10^{-4}$ | — | — | — |
| 25 | C-22 | Emul. | 100 | 1-1 | Emul. | $2.5 \times 10^{-4}$ | — | — | — |
| 26 | C-22 | Emul. | 100 | 1-1 | Emul. | $2.5 \times 10^{-4}$ | — | — | — |
| 27 | C-22 | Emul. | 100 | — | — | — | 2-1 | Emul. | $2.5 \times 10^{-4}$ |
| 28 | C-22 | Emul. | 100 | — | — | — | 2-1 | Emul. | $2.5 \times 10^{-4}$ |
| 29 | — | — | | 1-1 | Emul. | $2.5 \times 10^{-4}$ | — | — | — |
| 30 | — | — | | — | | — | 2-1 | Emul. | $2.5 \times 10^{-4}$ |
| 31 | Comp-1 | Emul. | 2.0 | 1-1 | Emul. | $2.5 \times 10^{-4}$ | — | — | — |
| 32 | Comp-1 | Emul. | 2.0 | — | — | — | 2-1 | Emul. | $2.5 \times 10^{-4}$ |

Prot.: Protective layer
Emul.: Emulsion layer

TABLE 2

| Sample No. | Phosphazene C-57 in developer (g/l) | Running stability (Sensitivity): Initial | 5 days | 10 days | Tone of silver image | Remarks |
|---|---|---|---|---|---|---|
| 1 | — | 100 | 92 | 78 | 1 | Comp. |
| 2 | — | 100 | 94 | 81 | 2 | Comp. |
| 3 | — | 102 | 98 | 93 | 4 | Inv. |
| 4 | — | 102 | 97 | 90 | 4 | Inv. |
| 5 | — | 100 | 96 | 91 | 3 | Inv. |
| 6 | — | 104 | 104 | 99 | 4 | Inv. |
| 7 | — | 101 | 98 | 95 | 4 | Inv. |
| 8 | — | 105 | 104 | 99 | 4 | Inv. |
| 9 | — | 102 | 99 | 95 | 4 | Inv. |
| 10 | — | 102 | 99 | 95 | 4 | Inv. |
| 11 | — | 100 | 97 | 93 | 3 | Inv. |
| 12 | — | 105 | 103 | 97 | 4 | Inv. |
| 13 | — | 101 | 99 | 96 | 4 | Inv. |
| 14 | — | 105 | 103 | 99 | 4 | Inv. |
| 15 | — | 104 | 103 | 100 | 4 | Inv. |
| 16 | — | 106 | 104 | 100 | 4 | Inv. |
| 17 | — | 101 | 99 | 97 | 4 | Inv. |
| 18 | — | 101 | 99 | 97 | 4 | Inv. |
| 19 | — | 101 | 99 | 95 | 4 | Inv. |
| 20 | — | 101 | 99 | 97 | 4 | Inv. |
| 21 | — | 102 | 99 | 95 | 4 | Inv. |
| 22 | — | 104 | 98 | 93 | 4 | Inv. |
| 23 | — | 104 | 102 | 98 | 4 | Inv. |
| 24 | — | 102 | 100 | 96 | 4 | Inv. |
| 25 | 1.0 | 104 | 103 | 100 | 4 | Inv. |
| 26 | 10.0 | 106 | 104 | 102 | 4 | Inv. |
| 27 | 1.0 | 103 | 100 | 97 | 4 | Inv. |
| 28 | 10.0 | 104 | 102 | 98 | 4 | Inv. |
| 29 | — | 100 | 95 | 82 | 1 | Comp. |
| 30 | — | 100 | 94 | 80 | 1 | Comp. |
| 31 | — | 88 | 82 | 69 | 2 | Comp. |
| 32 | — | 91 | 85 | 67 | 2 | Comp. |

It is understood from Tables 1 and 2 that the processing can be run with a high stability and a silver image having a pure black tone can be obtained by the processing method according to the invention.

Example 2

The developing solution and developer replenisher solution the same as those in Example 1 were pprepared. Furthermore 5 kinds of developing solution and repelnisher solution each the same as those the above-mentioned except that the compound A, B, C, D or E was respectively added in each of the solutions as shown in Table 3.

As the fixing solution and the fixer replenisher solution, those the same as in Example 1 were used.

<Evaluation of running stability>

The foregoing initial developing solution and fixing solution were charged in an automatic processor SRX-701 and the prcessing was performed in 30 second-mode. The processing was run under the following conditions. Each of the light-sensitive material samples shown in table 3 which were prepared in Example 1, was processed in a rate of 6.00 m$^2$ per day, after uniformly exposed to light so as to form an optical density of 1.0 after processing. Both of the development and the fixing were carried aut at 50° C. The processing was run for 3 weeks while replenishing the developer and fixer each in a rate of 150 ml/m$^2$ of the light-sensitive material processed.

<Evaluation of sensitiometric property>

A sheet of the light-sensitive material sample was exposed to X-ray in the same manner as in Example 1 and processed at the start time and after running of 3 weeks by SRX-701 in 30 second-mode.

<Evaluation of silver sludge>

After the running of processing, the degree of formation of silver sludge in the developing tank of the processor was visualy evaluated and classified in 5 ranks according to the followings.

Rank 5: No sludge was observed on the side and bottom walls of the developing tank.

Rank 4: A slight sludge was adhered on the side and bottom walls of the developing tank.

Rank 3: Sludge adhered on the side and bottom walls of the developing tank was observed.

Rank 2: Sludge was adhered on all parts of the developing tank.

Rank 1: A lot of sludge was formed in the developing tank and adhered on the processed light-sensitive material.

Results of the evaluation are shown in Table 3.

TABLE 3

| Test No. | Sample* No. | Compound of Formula A to E No. | Amount (mmole/l) | Fog | Sensitivity | $D_{max}$ | Silver sludge | Remarks |
|---|---|---|---|---|---|---|---|---|
| 1 | 1 | None | — | 0.185 | 78 | 3.05 | 2 | Comp. |
| 2 | 31 | None | — | 0.186 | 69 | 3.00 | 3 | Comp. |
| 3 | 1 | A-1 | 1.00 | 0.185 | 65 | 2.95 | 4 | Comp. |
| 4 | 1 | B-1 | 1.00 | 0.184 | 67 | 2.95 | 5 | Comp. |
| 5 | 1 | C-1 | 1.00 | 0.184 | 66 | 2.97 | 4 | Comp. |
| 6 | 1 | D-1 | 1.00 | 0.186 | 66 | 2.93 | 3 | Comp. |
| 7 | 1 | E-1 | 1.00 | 0.184 | 64 | 2.95 | 4 | Comp. |
| 8 | 6 | None | — | 0.188 | 96 | 3.40 | 4 | Inv. |
| 9 | 6 | A-1 | 1.00 | 0.186 | 99 | 3.45 | 5 | Inv. |
| 10 | 8 | A-1 | 1.00 | 0.186 | 98 | 3.47 | 5 | Inv. |
| 11 | 12 | A-1 | 1.00 | 0.185 | 99 | 3.50 | 5 | Inv. |
| 12 | 14 | A-1 | 1.00 | 0.185 | 97 | 3.48 | 5 | Inv. |
| 13 | 6 | B-1 | 1.00 | 0.185 | 99 | 3.50 | 5 | Inv. |
| 14 | 6 | C-1 | 1.00 | 0.185 | 97 | 3.48 | 5 | Inv. |
| 15 | 6 | D-1 | 1.00 | 0.187 | 96 | 3.46 | 5 | Inv. |
| 16 | 6 | E-1 | 1.00 | 0.185 | 98 | 3.48 | 5 | Inv. |

Sample*: Sample of light-sensitive material prepared in Example 1
Comp.: Test for comparison
Inv. : Teast according to the invention As is shown in Table 3, the stability of the running processing is excellent and the formation of sludge is inhibited in the processing according to the invention.

What is claimed is:

1. A method for processing a silver halide photographic light-sensitive material comprising the step of developing a silver halide photographic light-sensitive material which comprises a support having thereon a silver halide emulsion layer and a hydrophilic colloid layer adjoining with the silver halide emulsion layer, and at least one of the silver halide emulsion layer and the hydrophilic colloid layer contains a phosphazene compound and a compound represented by the following Formula 1 or 2 by a developing solution, fixing the silver halide photographic light-sensitive material by a fixing solution, Formula 1

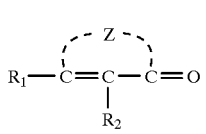

wherein $R_1$ and $R_2$ are each independently a hydroxyl group, a mercapto group, an amino group, an acylamino group, an alkylsulfonylamino group, an arylsulfonylamino group, an alkoxycarbonyl group or an alkylthio group, and Z is a group of atoms necessary to form a 5- or 6-member ring, Formula 2

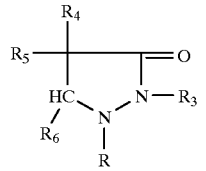

wherein R is an aryl group, $R_3$, $R_4$, $R_5$ and $R_6$ are each independently a hydrogen atom, an alkyl group, an aralkyl group or an aryl group.

2. The method of claim 1, wherein said silver halide emulsion layer contains said phosphazene compound and said compound represented by Formula 1 or 2.

3. The method of claim 1, wherein said compound represented by Formula 1 is contained in said silver halide emulsion layer or said hydrophilic colloid layer adjoined to the silver hailed emulsion layer in an amount of from $5\times10^{-5}$ moles to $5\times10^{-3}$ moles per mole of silver halide.

4. The method of claim 1, wherein said compound represented by Formula 2 is contained in said silver halide emulsion layer or said hydrophilic colloid layer adjoined to the silver hailed emulsion layer in an amount of from $5\times10^{-5}$ moles to $1\times10^{-1}$ moles per mole of silver halide.

5. The method of claim 1 wherein said phosphazene compound is a compound represented by the following Formula 3 or 4, Formula 3

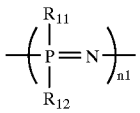

Formula 4

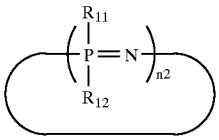

wherein $R_{11}$ and $R_{12}$ are each independently an alkyl group, an alkoxyl group, an aryloxyl group, an aryl group, an isothiocyanato group, an amino group, an alkylthio group or an azido group, n1 is an integer of 1 or more and n2 is an integer of 3 or more.

6. The method of claim 5, wherein said phosphazene compound represented by Formula 3 or 4 is contained in said silver halide emulsion layer or said hydrophilic colloid layer adjoined to said silver hailed emulsion layer in an amount of from $5\times10^{-4}$ moles to 1 mole per mole of silver halide.

7. The method of claim 5, wherein said silver halide emulsion layer contains said compound represented by Formula 1 or 2 and said phosphazene compound represented by Formula 3 or 4.

8. The method of claim 1, wherein said silver halide emulsion layer comprises a silver halide emulsion chemically sensitized in the presence of a selenium compound or a tellurium compound.

9. The method of claim 8, wherein said silver halide emulsion comprises a tabular silver halide grain having a grain thickness of from 0.01 $\mu$m to 0.50 $\mu$m and an aspect ratio of from 2 to 50.

10. The method of claim 1, wherein said developing solution or said fixing solution contains said phosphazene compound.

11. The method of claim 10, wherein said phosphazene compound contained in said developing solution is a compound represented by Formula 3 or 4.

12. The method of claim 11, said compound represented by Formula 3 or 4 is contained in said developing solution in an amount of from $2\times10^{-6}$ moles to 2 moles per liter.

13. The method of claim 11, wherein said developing solution further contains a compound represented by Formula 3 or 4 and a compound represented by the following Formula A, B, C, D or E, Formula A

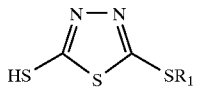

wherein $R_1$ is a hydrogen atom, an alkyl group having 1 to 6 carbon atoms, or an aminoalkyl group, a dialkylaminoalkyl group or a carboxylalkyl group each having an alkyl moiety having 1 to 6 carbon atoms, Formula B

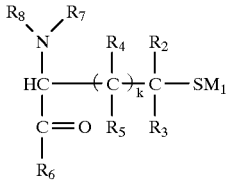

wherein B, $R_2$ and $R_3$ are each a hydrogen atom or an alkyl group having 1 to 3 carbon atoms provided that at least one of $R_2$ and $R_3$ is the alkyl group; $R_4$ and $R_5$ are each a hydrogen atom or an alkyl group having 1 to 3 carbon atoms; $R_6$ is a hydroxyl group including its metal salt, an amino group, or an alkyl group having 1 to 3 carbon atoms; $R_7$ and $R_8$ are each a hydrogen atom, an alkyl group having 1 to 5 carbon atoms, an acyl group having 18 or less carbon atoms or a —$COOM_{10}$ group, in which $M_{10}$ is a hydrogen atom, an alkyl group having 1 to 4 carbon atoms, an alkali metal atom, an aryl group, or an alkyl group having 15 or less carbon atoms, provided that at least one of $R_7$ and $R_8$ is a group other than hydrogen atom; $M_1$ is a hydrogen atom, an alkali metal atom or an ammonium group; and k is 0, 1 or 2, Formula C

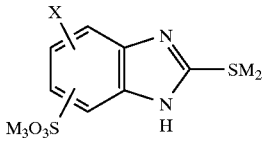

wherein X is a hydrogen atom, a hydroxyl group, a lower alkyl group, a lower alkoxyl group, a halogen atom, a carboxyl group or a sulfo group; $M_2$ and $M_3$ are each a hydrogen atom, an alkali metal atom or an ammonium group, Formula D

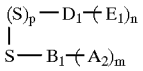

in Formula D, $D_1$ and $B_1$ are each independently an alkylene group; $E_2$ and $A_2$ are each independently a —COOM group, an —$SO_2M$ group, an —OM group, an —SZ group, an —$SO_2N(X_1)(Y_1)$ group or a —$CO(X_1)(Y_1)$ group, M is a cation such as $H^+$, and $X_1$ and $Y_1$ are each a hydrogen atom, a hydroxyl group, an alkyl group or phenyl group each may be substituted by a sulfo group or a carboxyl group, or a sulfonyl group which may be substituted by a phenyl group; Z is a hydroxyl group, an alkyl group or phenyl group each may be substituted by a sulfo group or a carboxyl group, or a sulfonyl group which may be substituted by a phenyl group; p is 1 or 2; and m and n is an integer of 1, 2 or 3;

Formula E

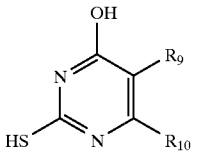

wherein $R_9$ and $R_{10}$ are each a hydrogen atom, an alkyl group, an aryl group, an aralkyl group, a hydroxyl group, a mercapto group, a carboxyl group, a sulfo group, a phosphono group, an amino group, a nitro group, a cyano group, a halogen atom, an alkoxyl group, an alkoxycarbonyl group, an aryloxycarbonyl group, a carbamoyl group, a sulfamoyl group or a heterocyclic group; $R_9$ and $R_{10}$ may be liked with together to form a ring.

14. The method of claim 13, wherein said compound represented by Formula A, B, C, D or E is contained in said developing solution in an amount of from $1\times10^{-5}$ moles to $1\times10^{-2}$ moles per liter.

15. The method of claim 1, wherein said processing is run using an automatic processor while replenishing the developing solution and the fixing solution by a replenisher for developing solution and a repelnisher for fixing solution, respectively, in a rate of from 30 ml to 180 ml per square meter of the silver halide photographic light-sensitive material to be processed.

* * * * *